US005409364A

United States Patent [19]

Schultheis et al.

[11] Patent Number: 5,409,364

[45] Date of Patent: Apr. 25, 1995

[54] EXTRUDER ASSEMBLY FOR MODELING COMPOSITION

[75] Inventors: Douglas A. Schultheis, Cumberland, R.I.; Christina M. Beecher, Norton, Mass.

[73] Assignee: Playskool, Inc., Pawtucket, R.I.

[21] Appl. No.: 164,700

[22] Filed: Dec. 9, 1993

[51] Int. Cl.[6] ..... B29C 45/10

[52] U.S. Cl. ..... 425/183; 425/186; 425/192 R; 425/544; 425/581; 249/102

[58] Field of Search ..... 425/183, 185, 186, 192 R, 425/190, 544, 581, DIG. 57; 249/102

[56] References Cited

U.S. PATENT DOCUMENTS

| | | | |
|---|---|---|---|
| 2,578,105 | 12/1951 | Taylor . | |
| 3,001,485 | 9/1961 | Czik | 425/183 |
| 3,130,468 | 4/1964 | McFall . | |
| 3,157,933 | 11/1964 | Boggild et al. . | |
| 3,167,440 | 1/1965 | McVicker et al. . | |
| 3,264,685 | 8/1966 | Boggild et al. . | |
| 3,590,749 | 7/1971 | Burns . | |
| 3,685,936 | 8/1972 | Meth et al. . | |
| 3,741,706 | 6/1973 | Conley et al. . | |
| 3,856,449 | 12/1974 | Fischer . | |
| 4,076,476 | 2/1978 | Ventura . | |
| 4,158,910 | 6/1979 | Hanas et al. | 425/183 |
| 4,569,815 | 2/1986 | Rentz et al. . | |
| 4,623,319 | 11/1986 | Zaruba et al. . | |
| 4,815,961 | 3/1989 | Kindred . | |
| 4,861,254 | 8/1989 | Takeuchi et al. . | |

*Primary Examiner*—Khanh Nguyen
*Attorney, Agent, or Firm*—Kurt R. Benson

[57] ABSTRACT

An apparatus for forming a modeling composition includes an extruder assembly for receiving and extruding a quantity of said modeling composition, and first and second mold assemblies of different sizes which are removably receivable on the extruder assembly for receiving modeling composition extruded therefrom. Each of the mold assemblies includes a rear plate portion and a front mold cavity portion which is preferably made of a transparent plastic material and adapted to be assembled with the plate portion thereof so that it cooperates therewith to define a mold cavity for receiving modeling composition therein from the extruder.

10 Claims, 6 Drawing Sheets

EXTRUDER ASSEMBLY FOR MODELING COMPOSITION

BACKGROUND AND SUMMARY OF THE INVENTION

The instant invention relates to modeling compositions of the general type disclosed in the McVicker et al, U.S. Pat. No. 3,167,440 and more specifically to an extruder for forming a modeling composition into predetermined molded shapes.

Because of the extremely high level of popularity with young children of modeling compositions of the general type disclosed in the aforementioned U.S. Patent to McVicker et al, a number of accessories and tools have been developed over the years for use in combination therewith. For example, the U.S. Patents to Taylor, No. 2,578,105; Boggild et al, No. 3,264,685; Burns, No. 3,590,749; Meth et al, No. 3,685,936; Conley et al, No. 3,741,706; Ventura, No. 4,076,476; Rentz et al, No. 4,569,815; Zaruba et al. No. 4,623,319; and Kindred, No. 4,815,961 disclose devices which are adapted for forming modeling compositions and which represent the closest prior art to the subject invention of which the applicant is aware. Other related devices which are believe to be of more general interest are disclosed in the U.S. Patents to McFall, No. 3,130,468; Boggild et al, No. 3,157,933; Fischer, No. 3,856,449; and Takeuchi et al, No. 4,861,254. However, the prior art has generally failed to provide an effective device which is capable of extruding a modeling composition into molds of various sizes and shapes, and hence, the above references are believed to be of only general interest with respect to the subject invention.

The instant invention provides an effective apparatus for extruding a modeling composition into various different molds in order to form the modeling composition into various predetermined shapes. Specifically, the apparatus of the instant invention comprises an extruder assembly for receiving a quantity of modeling composition therein, a first mold of a predetermined size and shape which is adapted for receiving modeling composition therein, means for removably retaining the first mold in a predetermined receiving position adjacent the extruder assembly, a second mold of a different predetermined size and shape adapted for receiving the modeling composition therein, and means for alternatively removably retaining the second mold in a predetermined receiving position for receiving modeling composition from the extruder assembly. The extruder assembly preferably includes a front face plate having an extrusion opening therein, and it is preferably operative for extruding modeling composition so that it is passed outwardly through the extrusion opening in the face plate. The means for removably retaining the first mold is preferably operative for retaining the first mold in engagement with the front face plate, and the means for alternatively removably retaining the second mold is preferably operative for removably retaining the second mold in engagement with the front face plate. Further, the first retaining means preferably comprises a first channel member of semi-circular configuration on the front face plate which is concentrically oriented relative the extrusion opening. The second retaining means preferably comprises a second channel member of semi-circular configuration on the front face plate which is also concentrically oriented relative to the extrusion opening. The first and second molds preferably include first and second peripheral flanges, respectively, which are dimensioned to be received in the first and second channel members, respectively, for alternatively releasably retaining the first and second molds on the face plate. The second channel member is preferably disposed forwardly of the first channel member relative to the face plate so that it is operative for positioning the peripheral flange on the second mold in forwardly spaced relation to the face plate. Accordingly, the second mold preferably includes a rearwardly extending tubular extension which engages the face plate around the extrusion opening for passing modeling composition from the extrusion opening into the second mold. At least one of the first and second molds includes a front mold cavity portion and a rear plate portion having an aperture therethrough for receiving modeling composition in the front mold cavity portion thereof. The front mold cavity portion is preferably made of a transparent plastic material, and it is preferably detachably secured to the rear plate portion thereof so that it cooperates with the rear plate portion to define a mold cavity of a predetermined configuration. Still further, in one embodiment, one of either the front mold cavity portion or the rear plate portion includes an interrupted wall portion extending around the aperture in the rear plate portion so that modeling composition passing into the mold cavity through the interrupted wall portion is distributed outwardly through the interruptions or openings in the wall portion.

It has been found that the apparatus of the instant invention has a relatively high level of play value and that it can be effectively utilized for extruding modeling composition into molds of various shapes and forms. Specifically, it has been found that because the apparatus is adapted for alternatively receiving molds of two different sizes on the front face plate, the apparatus has an increased level of versatility as compared to the previously available devices. Further, because the apparatus includes channel members of two different sizes for receiving and securing molds on the front face plate, the apparatus can be easily and effectively operated by a young child. Still further, because the apparatus includes a mold having an interrupted wall extending around the aperture in the rear plate portion thereof and a transparent front mold cavity portion, the apparatus is operative for extruding a modeling composition into a mold in a manner which provides an amusing visual effect as the modeling composition in passed into the mold cavity.

Accordingly, it is a primary object of the instant invention to provide an effective apparatus for alternatively extruding a modeling composition into a plurality of different molds of different sizes and shapes.

Another object of the instant invention is to provide an apparatus comprising an extrusion assembly and a plurality of molds of different sizes and shapes which are releasably securable to a front plate portion of the extrusion assembly for receiving a modeling composition therefrom.

And even still further object of the instant invention is to provide an apparatus for extruding a modeling composition into a mold, wherein the mold includes a transparent front cavity portion and an interrupted wall portion for producing an amusing visual effect as modeling composition is extruded into the mold.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
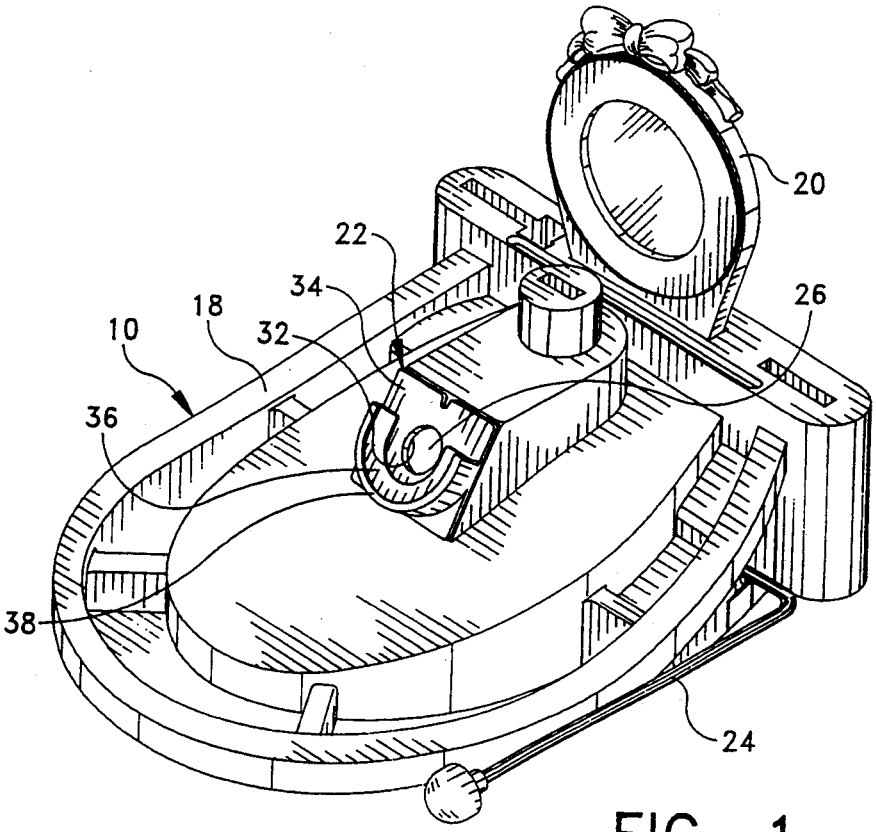
FIG. 1 is a perspective view of the extrusion assembly of the instant invention without a mold assembly received thereon but with the extrusion assembly in an advanced position.
Figure 2:
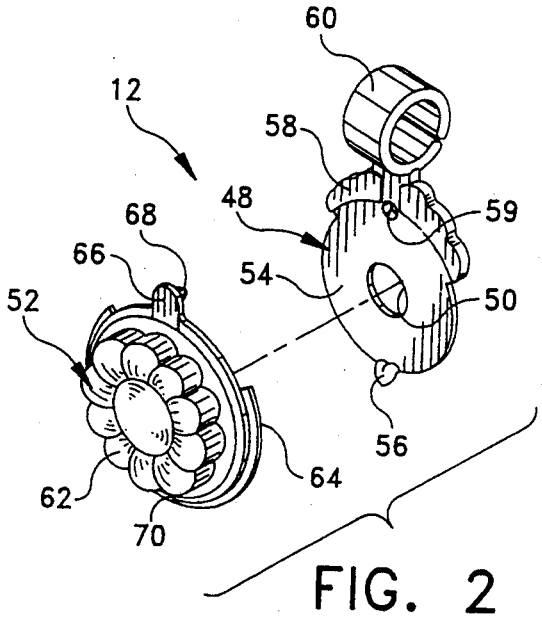
FIG. 2 is a front exploded perspective view of a first mold assembly.
Figure 3:
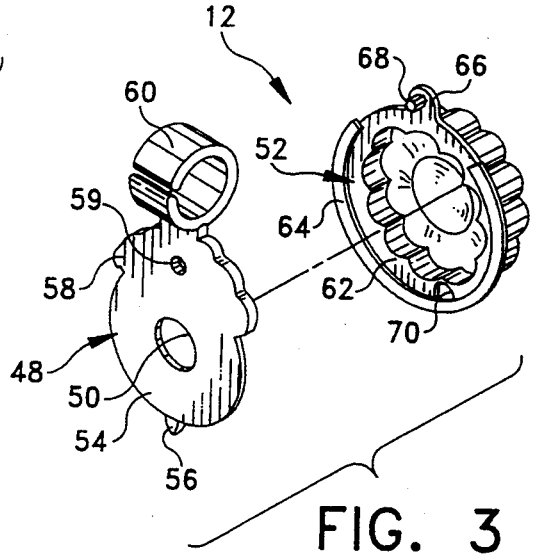
FIG. 3 is a rear exploded perspective view thereof.
Figure 4:
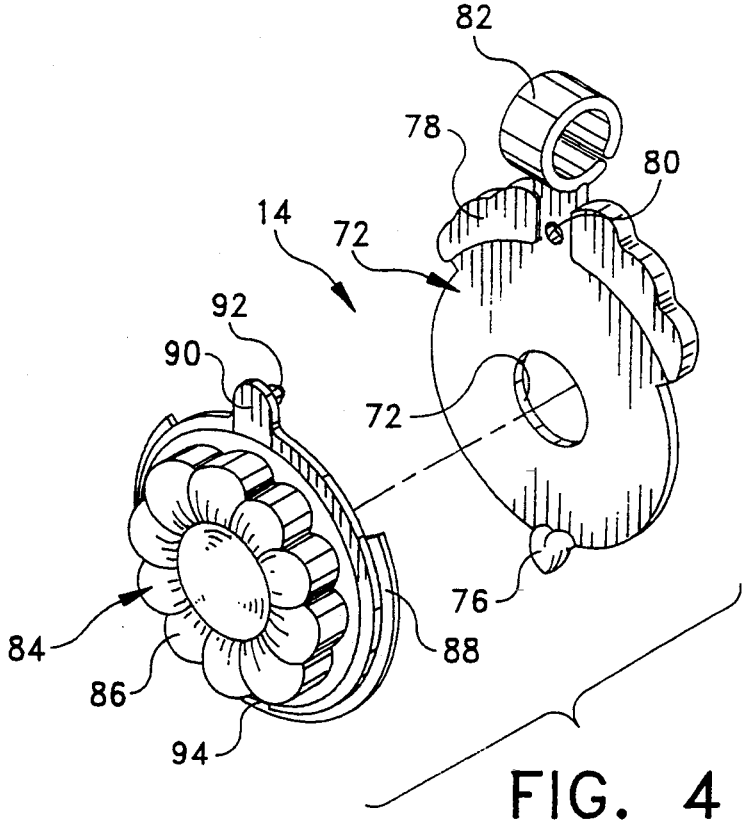
FIG. 4 is a front exploded perspective view of a second mold assembly.
Figure 5:
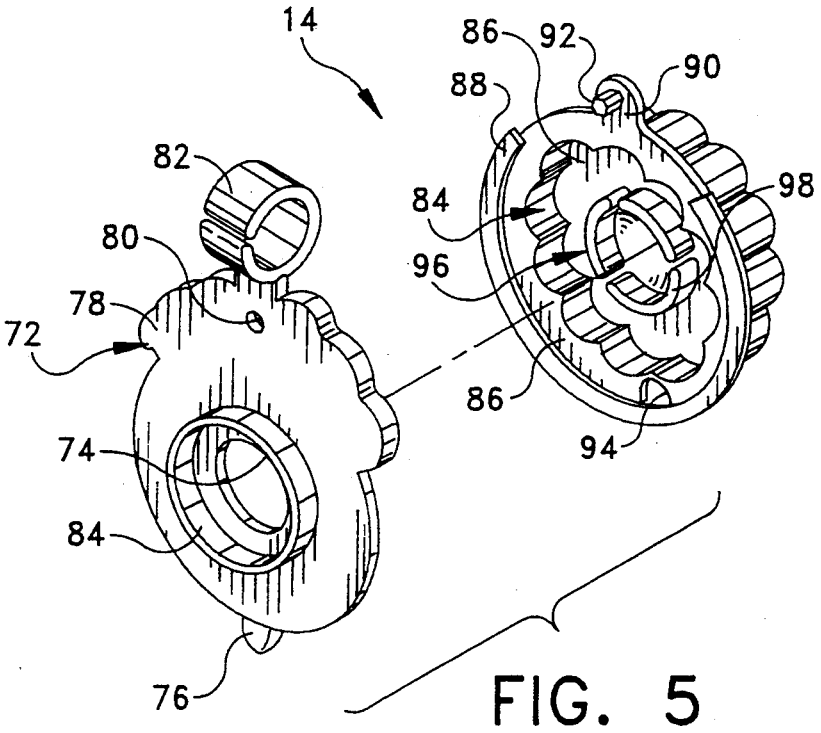
FIG. 5 is a rear exploded perspective thereof.
Figure 6:
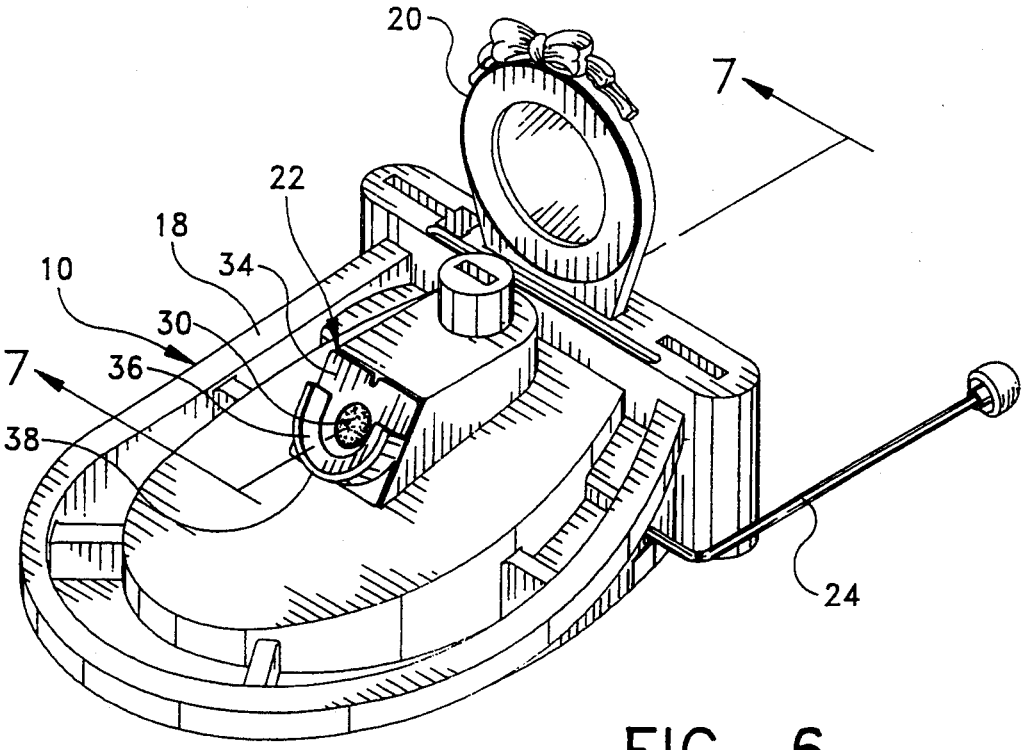
FIG. 6 is a perspective view of the extrusion assembly without a mold assembly received thereon, but with the extrusion assembly in a retracted position.
Figure 7:
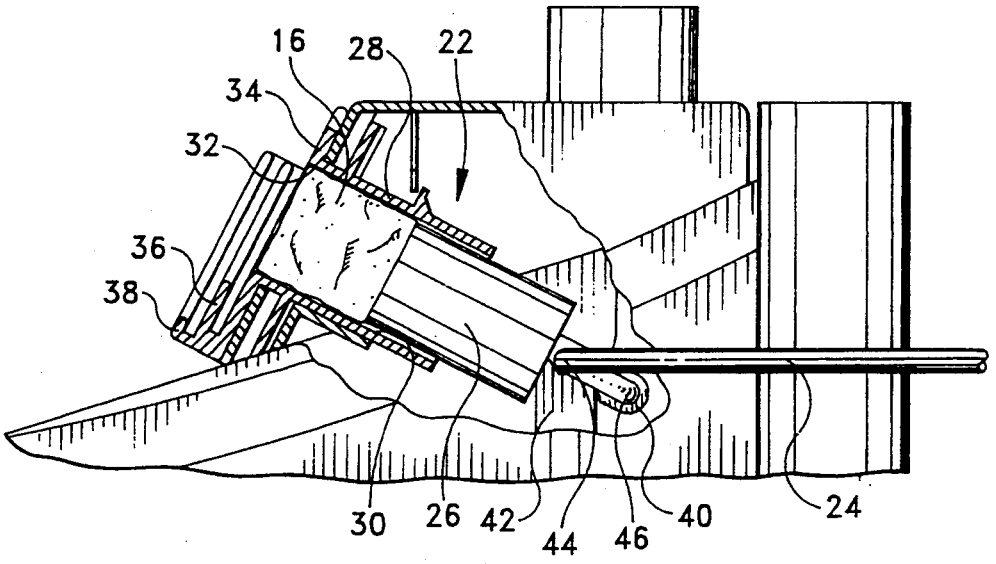
FIG. 7 is a sectional view taken along line 7—7 in FIG. 6.
Figure 8:
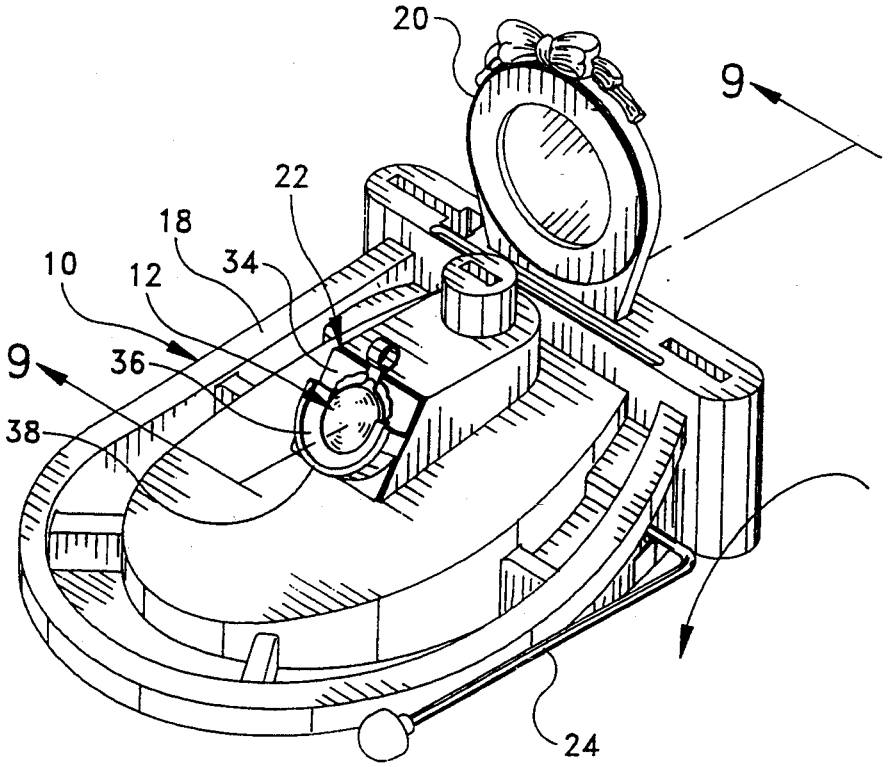
FIG. 8 is a perspective view of the extruder assembly with the first mold assembly received thereon and with the extruder assembly in an advanced position.
Figure 9:
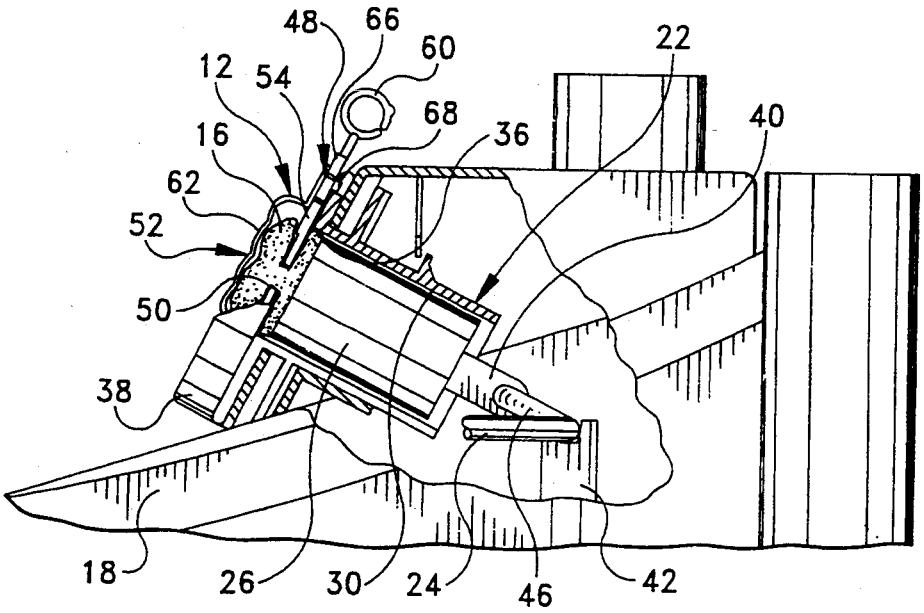
FIG. 9 is a sectional view taken along line 9—9 in FIG. 8.
Figure 10:
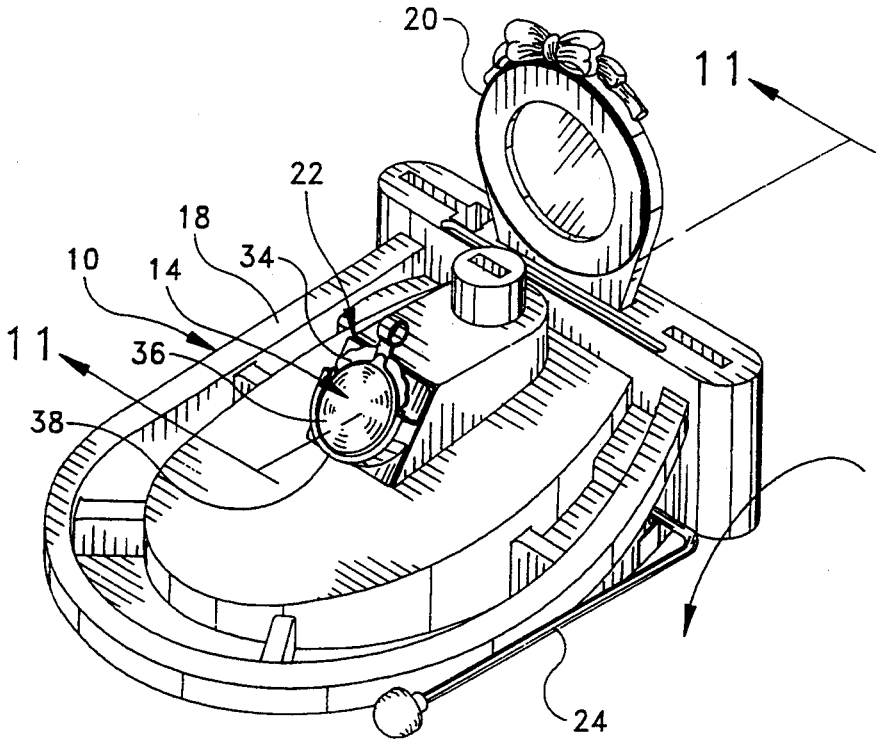
FIG. 10 is perspective view of the extruder assembly with the second mold assembly received thereon, and with the extruder assembly in an advanced position.
Figure 11:
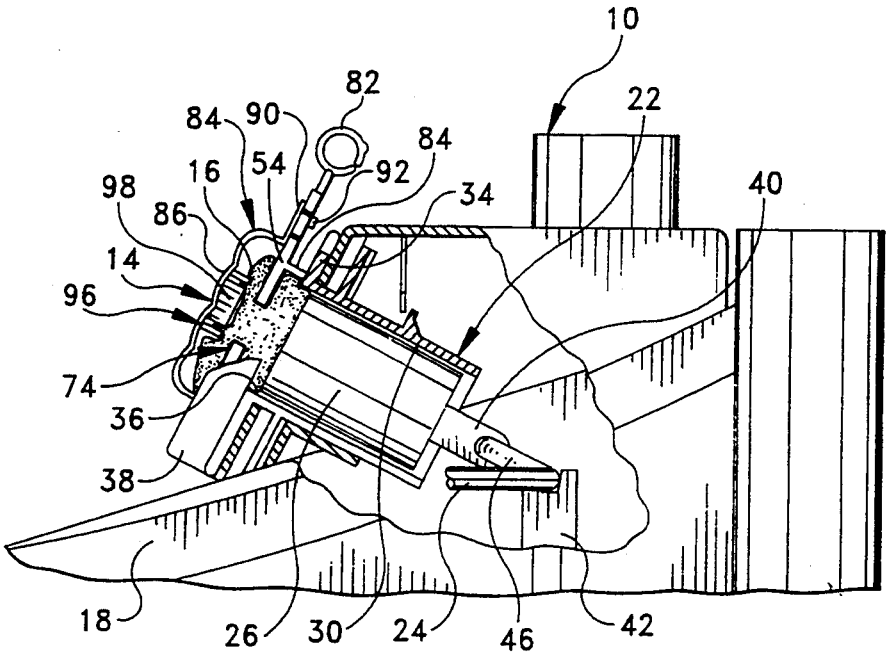
FIG. 11 is a sectional view taken along line 11—11 in FIG. 10.
Figure 12:
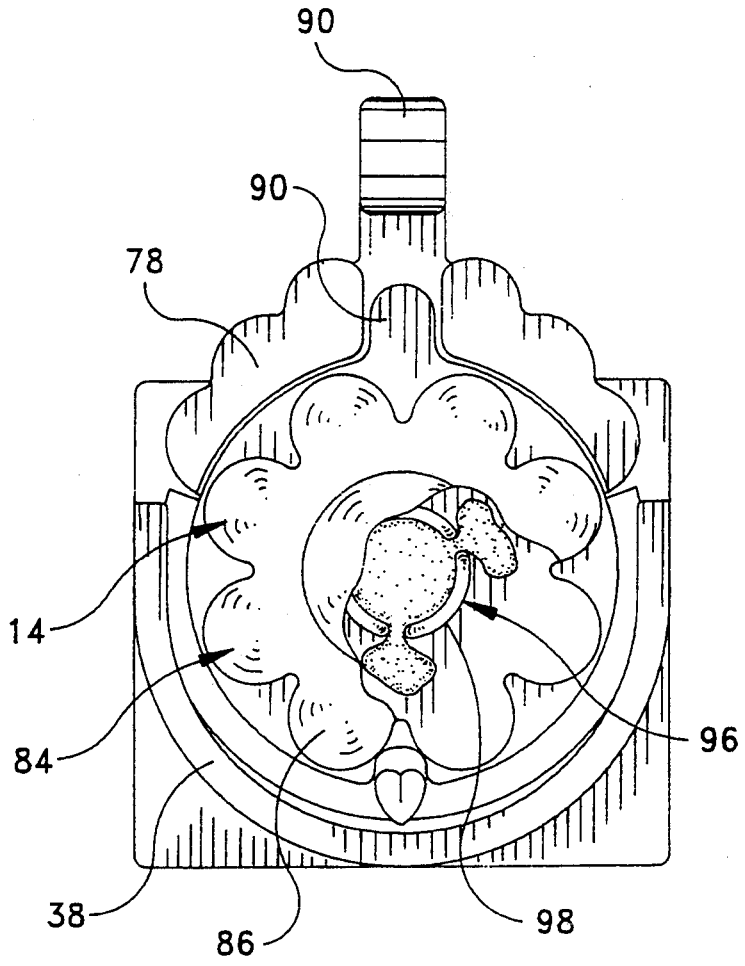
FIG. 12 is a front elevational view of the extruder assembly as operated during an extrusion operation with the first mold assembly received thereon.

Referring now to the drawings, the extrusion assembly of the apparatus of the instant invention is illustrated in FIGS. 1 and 6 through 11 and generally indicated at 10. The extrusion assembly 10 is adapted to be alternatively utilized in combination with a first mold assembly generally indicated at 12 in FIGS. 2, 3, 8, 9 and 12 or a second mold assembly generally indicated at 14 in FIGS. 4, 5, 10 and 11. Specifically, as illustrated in FIGS. 8 through 12 the extrusion assembly 10 is adapted so that it is alternatively operative for extruding a modeling composition 16 into one of the mold assemblies 12 or 14 in order to form the modeling composition 16 into a predetermined molded configuration as will hereinafter be more fully set forth.

The extrusion assembly 10 is illustrated most clearly in FIGS. 1 and 6 through 11, and it comprises a base or housing 18 which is preferably integrally molded from a suitable rigid plastic material, an ornamental mirror portion 20 which is removably received on the housing 18, a piston and cylinder assembly generally indicated at 22 and an actuating lever 24. The piston and cylinder assembly 22 is mounted in the housing 18 in the manner illustrated in FIGS. 7 and 9, and it includes a piston 26 and a cylinder 28. The cylinder 28 has an elongated tubular bore 30 formed therein which opens outwardly through an outlet opening 32. The outlet opening 32 passes through a front face plate 34 which is integrally formed with the cylinder 28, and first and second channel elements 36 and 38, respectively, are integrally formed with the face plate 34 as will hereinafter be more fully set forth. As illustrated, the piston 26 is adapted to slidably travel in the cylinder 28 for advancing the modeling composition 16 so that it passes outwardly through the opening 32. The piston 26 is preferably also integrally formed from a suitable plastic material, and a crank arm 40 is pivotally attached to the rear end of the piston 26. The actuating lever 24 is received in a pair of mounts 42 in the housing 18 so that it is pivotable about an axis 44. The lever arm 24 has a U-shaped bend 46 formed therein which is attached to the crank arm 40 so that as the lever arm 24 is pivoted about the axis 44, the crank arm 40 is advanced or retracted in a direction which extends along the axis of the cylinder 28 in order to advance or retract the piston 26 in the cylinder 28. Accordingly, as the operating lever 24 is pivoted forwardly, it causes the piston 26 to be advanced forwardly in the cylinder 28 for extruding the modeling composition 16 outwardly through the opening 32. However, when the operating lever 24 is pivoted rearwardly relative to the housing 18, the piston 26 is retracted in the cylinder 28 so that a new charge of modeling composition 16 can be loaded into the cylinder 28.

The first mold assembly 12 comprises a rear plate portion generally indicated at 48 having a central aperture 50 therethrough and a front mold cavity portion generally indicated at 52. The rear plate portion 48 includes a substantially circular central or main portion 54 having a tab 56 thereon and a decorative hanger portion 58 having an aperture 59 therethrough and including a hanger loop 60. The front molded cavity portion 52 includes a circular cavity section 62 having a circular peripheral flange 64 thereon and an upwardly extending tab 66 having a rearwardly extending pin 68 thereon. The front mold cavity portion 52 has an aperture 70 formed therein at a diametrically opposite position from the tab 66, and it is adapted to be assembled with the rear plate portion 48 so that it cooperates therewith to define a hollow mold cavity for receiving the modeling composition 16 therein. In this regard, the circular cavity section 62 is formed so that the rear side thereof defines a hollow concave area of a predetermined configuration which cooperates with the main portion 54 of the plate portion 48 to define a mold cavity. The flange portion 64, on the other hand, is dimensioned to be received around the periphery of the main portion 54 so that the plate portion 48 and the front mold cavity portion 52 are releasably secured in a position wherein they cooperate to define a mold assembly which is adapted to be received in the semi-circular first channel member 36 for receiving the modeling composition 16 from the opening 32. Specifically, the mold assembly 12 is adapted to be received in a position wherein the flange 64 is received in the first channel member 36 in the manner illustrated in FIGS. 8 and 9 so that the rear plate portion 48 is retained in snug engagement with the front face plate 34 whereby modeling composition 16 passing outwardly through the opening 32 is passed directly into the interior cavity of the mold assembly 12. Further, the first mold assembly 12 is formed in the general configuration of a hollow pendant which is adapted to receive a quantity of modeling composition 16 therein so that the transparent portions of the pendant take on the color of the modeling composition 16. It will be understood, however that other embodiments of the subject invention which include molds which are formed as other items, such as broaches, pins, earrings or other non-jewelry items, which include transparent components are also contemplated.

The second mold assembly 14 as herein embodied is generally similar to the first mold assembly 12, although it is of slightly larger diameter so that it is adapted to be assembled in the second channel member 38 rather than in the first channel member 36. Accordingly, the second mold assembly 14 includes a rear plate portion, generally indicated at 72 having an aperture 74 therein and including a tab 76 and a decorative portion 78 having an aperture 80 therein and a hanger element 82. The rear plate portion 72 further includes a rearwardly extending tubular extension 84 on the rear side thereof. The extension 84 extends rearwardly around the opening 74 so that it engages the front face plate 34 when the second mold assembly 14 is received in the second or forward channel member 38. Accordingly, the extension 84 is operative for passing modeling compound 16 from the opening 32 so that the modeling compound 16 passes into the interior of the second mold assembly 14. The second mold assembly 14 further includes a front mold cavity portion generally indicated at 84 including a cavity section 86 having a peripheral flange 88 thereon. The forward mold cavity portion 84 is made of a transparent plastic material, and it further includes an upper tab 90 having a rearwardly extending pin 92 thereon, and it has an aperture 94 formed therein at a diametrically opposite position from the tab 90. The front mold cavity portion 84 further includes a segmented annular wall 96 which extends rearwardly from the cavity section 86 so that the segmented wall 96 extends around the opening 74 when the forward mold cavity section 84 is assembled with the rear plate portion 72. The segmented wall 96 is defined by a plurality of individual segments 98 which extend integrally rearwardly from the cavity section 86 toward the plate portion 72 when the cavity portion 84 is assembled therewith. As a result, when the second mold assembly 14 is assembled in the forward or second semi-circular channel member 38, modeling composition 16 which is injected into the interior cavity in the second mold assembly 14 must pass between the wall segments 98 so that it is injected into the interior cavity in an unusual and interesting flow pattern which adds further play value to the apparatus 10.

Accordingly, for use and in operation of the apparatus 10 the operating lever 24 is pivoted to a rearward position in order to retract the piston 26 in the cylinder 30. A quantity of the modeling composition 16 is then manually placed in the interior of the cylinder 30 so that it can later be extruded from the cylinder 30 with the piston 26. One of the mold assemblies 12 or 14 is then assembled with the appropriate semi-circular channel 36 or 38, respectively, so that the selected mold assembly 12 or 14 is positioned for receiving modeling composition therein from the extruder assembly 22. The actuating lever 24 is then pivoted forwardly to inject a quantity of modeling composition 16 into the selected mold assembly 12 or 14. In this regard, when the apparatus 10 is used in combination with the first mold assembly 12, modeling composition 16 is extruded directly from the opening 32 through the aperture 50 so that it passes into the interior cavity defined by the rear plate portion 48 and the front mold cavity portion 52. Once a quantity of modeling composition 16 has been injected into the mold cavity in the assembly 12, the mold assembly 12 with the modeling composition 16 received therein can be removed from the channel 36. When the front mold cavity portion 52 is constructed from a transparent plastic material, the modeling composition 16 therein is visible to impart a unique appearance to the assembly formed by the mold assembly 12 and the modeling composition 16 therein. The composite assembly thereby formed can then be used as a pendant by attaching it to a necklace or the like utilizing the hanger element 60. Other mold assemblies of other configurations, such as those formed as other jewelry items can be used in a similar manner. Further, alternatively, the mold assembly 12 can be opened and the modeling composition which has been formed into a predetermined configuration as defined by the mold assembly 12 can be removed. On the other hand, when the apparatus 10 is utilized in combination with the second mold assembly 14, the modeling composition 16 must pass through the extension 84 and then between the wall segments 98 as it enters the cavity defined by the front cavity portion 84 and the rear plate portion 72. Further, as the modeling composition 16 is injected into the cavity in the interior of the second mold assembly 14, the wall segments 98 cause the modeling composition 16 to be dispersed in a unique and interesting manner as it passes into the cavity. Once a quantity of the modeling composition 16 has been passed into the mold assembly 14, the mold assembly 14 can be disengaged from the channel 38 so that it can also be used as a pendant in the manner hereinabove described with respect to the mold assembly 12. The modeling composition 16 can also be removed from the mold assembly 14 to provide a quantity of modeling composition which has been formed into an interesting predetermined configuration.

It is seen therefore that the instant invention provides an effective apparatus for forming a modeling composition. The apparatus 10 can be effectively utilized in combination with either of the mold assemblies 12 or 14 or with other similar mold assemblies to form a wide variety of different elements which include quantities of the modeling composition 16. The apparatus 10 is simple and easy to operate, and it provides a unique and amusing apparatus for forming a modeling composition in a mold assembly. Hence, it is seen that the apparatus of the instant invention represents a significant advancement in the art relating to forming apparatus for modeling compositions which has significant commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An apparatus for forming a modeling composition comprising:

an extruder assembly for receiving a quantity of said modeling composition therein and for extruding said modeling composition outwardly through an extrusion opening;

a first mold of a first predetermined size adapted for receiving said modeling composition therein;

first removable retaining means on said extruder for removably retaining said first mold in a predetermined position thereon adjacent said receiving opening for receiving said modeling composition therein from said extruder assembly;

a second mold of a different second predetermined size from said first mold and adapted for receiving said modeling composition therein; and second removable retaining means on said extruder separate and independent from said first retaining means and operable for alternatively removably retaining said second mold in a predetermined position adjacent said receiving opening for receiving said modeling composition therein from said extruder assembly.

2. In the apparatus of claim 1, said extruder assembly including a front face plate, said extrusion opening passing through said front face plate, said means for removably retaining said first mold being operative for removably retaining said first mold in engagement with said front face plate, said means for removably retaining said second mold being operative for removably retaining said second mold in engagement with said front face plate.

3. In the apparatus of claim 2, said means for removably retaining said first mold comprising a first channel member on said front face plate, said means for removably retaining said second mold comprising a second channel member on said front face plate.

4. In the apparatus of claim 3, said first and second channel members being of semi-circular configuration and of different diameters and being concentrically oriented on said front face plate with respect to said extrusion opening.

5. In the apparatus of claim 4, said first and second molds each including a peripheral flange which is dimensioned to be received in the respective channel member thereof for alternatively releasably retaining said first and second molds on said face plate.

6. In the apparatus of claim 5, said second channel member being disposed forwardly of said first channel member relative to said face plate for positioning the peripheral flange on said second mold in forwardly spaced relation to said face plate.

7. In the apparatus of claim 6, said second mold member including a rearwardly extending tubular extension for receiving modeling composition passing through said extrusion opening and passing it into said second mold.

8. In the apparatus of claim 1, one of said first and second molds including a front mold cavity portion and a rear plate portion having an aperture therein for receiving modeling composition therethrough, said front mold cavity portion being detachably secured to said rear plate portion and cooperating therewith to define a mold cavity of a predetermined configuration.

9. In the apparatus of claim 8, said front mold cavity portion being transparent, one of said front mold cavity portion or said rear plate portion including an interrupted wall portion inside of said cavity extending between said front mold cavity portion and said rear plate portion around said aperture in said rear plate portion, whereby modeling composition passing into said mold cavity must pass through said interrupted wall portion to distribute said modeling composition in said mold cavity.

10. In the apparatus of claim 9, said front mold cavity portion being transparent.

* * * * *